US006719597B2

(12) United States Patent
Yoshioka et al.

(10) Patent No.: US 6,719,597 B2
(45) Date of Patent: Apr. 13, 2004

(54) TILT-UP HANDLE FOR OUTBOARD MOTOR

(75) Inventors: Hidehiko Yoshioka, Hamamatsu (JP); Shuichi Hagino, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/246,386

(22) Filed: Sep. 18, 2002

(65) Prior Publication Data

US 2003/0054708 A1 Mar. 20, 2003

(30) Foreign Application Priority Data

Sep. 18, 2001 (JP) ..... 2001-283546

(51) Int. Cl.[7] ..... B63H 21/36
(52) U.S. Cl. ..... 440/77; 440/88 A; 123/195 C
(58) Field of Search ..... D15/4; 440/76, 440/77, 78, 88 R, 88 A, 900; 123/195 C, 195 P

(56) References Cited

U.S. PATENT DOCUMENTS

| | | | | | |
|---|---|---|---|---|---|
| 4,952,180 | A | * | 8/1990 | Watanabe et al. | 440/77 |
| 4,968,276 | A | * | 11/1990 | Hashimoto | 440/77 |
| 5,046,976 | A | * | 9/1991 | Kobayashi et al. | 440/77 |
| D323,508 | S | * | 1/1992 | Hirshberg et al. | D15/4 |
| 5,181,871 | A | * | 1/1993 | Hiraoka et al. | 440/77 |
| 5,328,395 | A | * | 7/1994 | Oishi | 440/77 |
| 5,425,336 | A | * | 6/1995 | Nakayama | 123/198 R |
| 5,573,436 | A | | 11/1996 | Trudeau et al. | 440/77 |
| D387,775 | S | * | 12/1997 | Iekura | D15/4 |
| 5,743,228 | A | * | 4/1998 | Takahashi | 123/195 P |
| 5,820,425 | A | * | 10/1998 | Ogino et al. | 440/78 |
| 5,928,043 | A | | 7/1999 | Rinzaki | 440/77 |
| 6,024,616 | A | | 2/2000 | Takayanagi | 440/77 |

FOREIGN PATENT DOCUMENTS

| | | | |
|---|---|---|---|
| JP | 06-122396 | 5/1994 | |
| JP | 06-129258 | 5/1994 | F02B/67/00 |
| JP | 9-240588 | 9/1997 | B63H/20/00 |

* cited by examiner

*Primary Examiner*—S. Joseph Morano
*Assistant Examiner*—Ajay Vasudeva
(74) *Attorney, Agent, or Firm*—Darby & Darby

(57) ABSTRACT

A tilt-up handle for an outboard motor is placed in the upper rear portion of an engine cover accommodating an engine and has an outside-air inlet opening rearwardly in the boat traveling direction. The outside-air inlet protrudes rearwardly in the boat traveling direction from a rear wall of the engine cover so as to be substantially aligned with an imaginary vertical line overlapping with the rear wall of the engine cover when the outboard motor is viewed in profile. The tilt-up handle prevents moisture from entering and allows outside air to enter an engine cover without compromising air intake.

9 Claims, 13 Drawing Sheets

TILT-UP HANDLE FOR OUTBOARD MOTOR

FIELD OF THE INVENTION

The present invention relates to a tilt-up handle for an outboard motor that transfers outside air into an engine cover. The engine cover houses an engine.

BACKGROUND OF THE INVENTION

FIG. 13 is a side view of a typical outboard motor, and FIG. 14 is a cross-sectional view of an upper cover segment of an engine cover of a typical outboard motor.

An outboard motor 1, as shown in FIG. 13, includes a driving-shaft housing 4 and a gear case 5 which connects to the bottom of an engine cover 3 that can house an engine such as a water-cooled four-cycle engine 2.

The engine cover 3 is divided vertically into two segments, an upper cover 3*a* and a lower cover 3*b*. A tilt-up-handle mounting portion 3*c*, as shown in FIG. 14, is formed as a concave cut-out in the upper rear portion of the upper cover 3*a*. An outside-air intake path 3*c*' extends vertically through this rear portion of the upper cover 3*a*. A tilt-up handle 8 with a louver 7 is mounted at a rear opening 6 in the tilt-up-handle mounting portion 3*c*. This opening opens toward the rear in a boat traveling in direction β.

The surface of the tilt-up handle 8 described above is continuous with and does not protrude from the surface of the engine cover 3. The louver 7 and air intakes 7*a* and 7*b* formed in the tilt-up handle 8 point slightly upward so that water drops and mist can easily enter the tilt-up handle 8 through the air intakes 7*a* and 7*b*. Typical louver 7 designs attempted to prevent water drops and mist from entering the engine cover 3 by reducing the aperture size of the air intakes 7*a* and 7*b* and by placing the intake port 3*c*" of the outside-air intake path 3*c*' at a position higher in the engine cover 3 than the position of the louver 7.

However, reducing the aperture size of the air intakes 7*a* and 7*b* of the louver 7 decreases the amount of outside air taken into the engine cover 3, thereby risking insufficient air intake. Furthermore, reducing the aperture size will cause the intake speed of outside air to increase, which, in turn, will make it easier for mist to enter the engine cover 3.

The amount of outside air taken into the engine cover 3 will also decrease when the height of the intake port 3*c*" of the outside-air intake path 3*c*' is raised above the louver 7, thereby again risking an insufficiency in air intake similar to that described above.

Installation of a structure for separating water drops and the like from intake air in the tilt-up handle 8 would make the configuration of the tilt-up handle 8 complex, difficult to machine, and costly.

SUMMARY OF THE INVENTION

Accordingly, the present invention provides a simple tilt-up handle for an outboard motor that prevents water drops and mist from entering the engine cover.

The present invention provides a tilt-up handle for an outboard motor positioned in the upper rear of an engine cover. The tilt-up handle includes an outside-air inlet opening rearwardly from the traveling direction of a boat β. The outside-air inlet protrudes rearwardly from a rear wall of the engine cover so as to be substantially (i.e., at least partially) aligned with an imaginary vertical line extending from the rear wall of the engine cover when viewed in profile. Water drops falling along the surface of the engine cover or the tilt-up handle will fall along the rear wall of the engine cover and not near the outside-air inlet.

This structure is simple to manufacture, prevents water drops from entering the engine cover, and prevents water drops from producing a mist by splashing near the outside-air inlet.

An upper wall of the tilt-up handle can be formed to bulge upward gradually from the upper wall of the engine over in the boat traveling direction β. This increases the internal volume of the tilt-up handle without increasing the size of the engine cover.

Outside air flows in from the lower diagonal side of a louver which is mounted at the outside-air inlet and opens toward the rear in the boat traveling direction β. This makes it possible to control the air flow from the outside easily and effectively to prevent water drops from entering the engine cover.

The louver can be provided with an intake-port forming surface pointing diagonally downward toward the rear. This configuration prevents water drops from falling along the intake-port forming surface into the louver and effectively prevents water drops from entering the engine cover.

An upper end of the intake-port forming surface can protrude rearwardly in the boat traveling direction β to form a shape resembling eaves. The eaves-shaped upper end can also prevent water drops from contacting the intake-port forming surface.

A ventilation opening can be formed in at least one of the right and left sides of the tilt-up handle in which a ventilating fan can be provided. In this case, even if water drops and mist were taken into the tilt-up handle, they can be quickly discharged to the outside so that water drops and the like can be prevented from entering the engine cover.

Additional features and advantages of the present invention will become apparent from the following description of the preferred embodiments with reference to the attached drawings.

DESCRIPTION OF THE PREFERRED EMBODIMENTS

Figure 3:
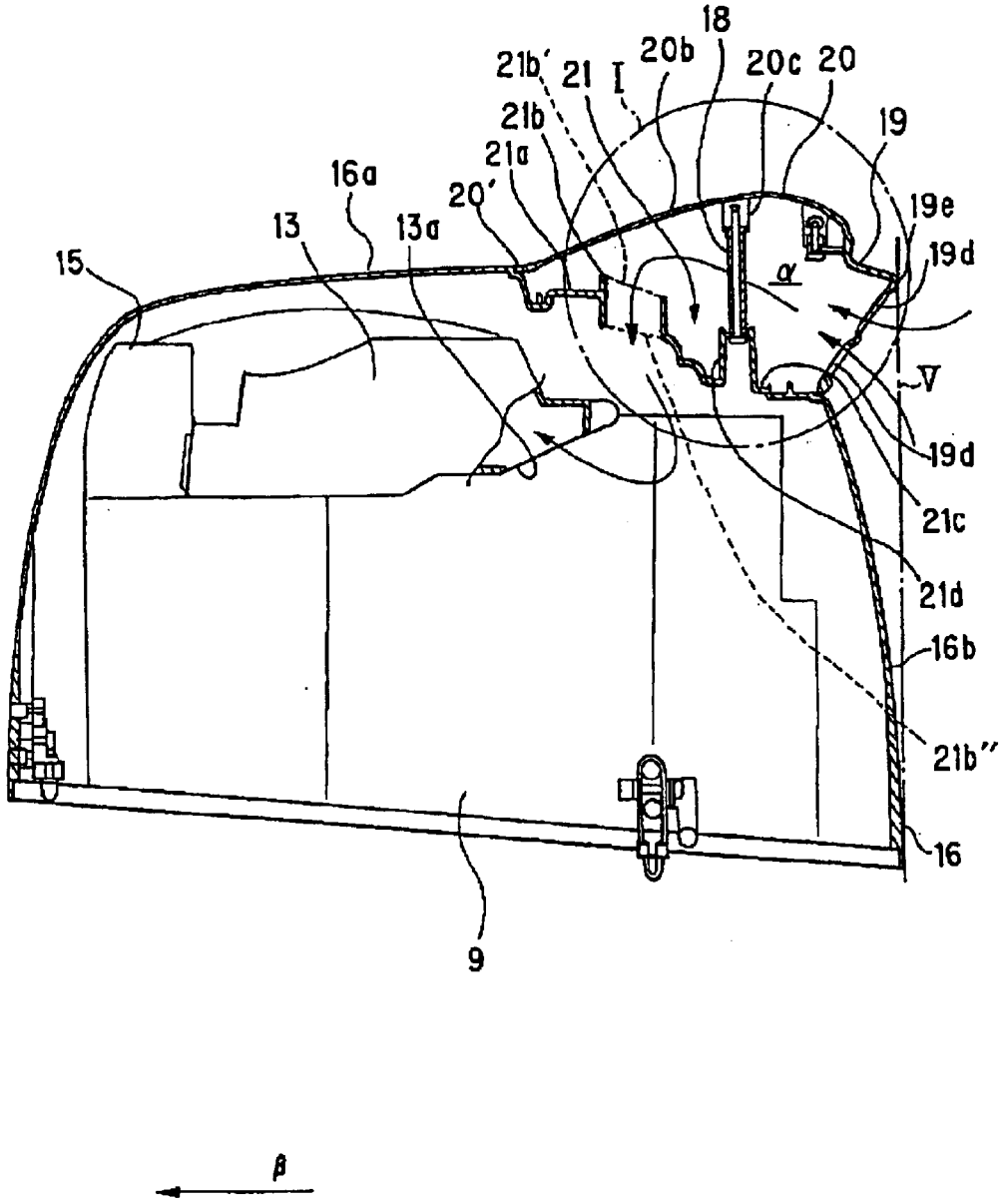
FIG. 3 is a cross-sectional view of an upper cover segment of an engine cover.

In an outboard motor A, a driving-shaft housing 11 is located above a gear case 12 and below an engine cover 10 housing a water-cooled four-cycle engine 9, as shown in FIG. 3.

A crankshaft (not shown) is placed upright in the engine 9 which sits on an engine holder (not shown) in the engine cover 10.

A silencing duct 13 on the engine 9 is coupled to a carburetor 15 on the upper front side of the engine 9. An air inlet 13*a* opening diagonally downward is located at the rear side of the silencing duct 13.

Outside air flows through air inlet 13*a* from outlet port 21*b*" which is located at the lower end of an outside-air intake path 21*b*. The air inlet 13*a* is arranged diagonally downward to keep out water droplets and to keep out mist formed by any droplets flowing into the engine cover 10 through the outside-air intake path 21*b*.

A driving shaft (not shown) passes through the driving-shaft housing 11 and into the gear case 12. This shaft rotates with the lower end of the crankshaft (not shown) of the engine 9.

A propeller shaft (not shown) rotates horizontally inside the gear case 12, and a screw propeller 14 rotates on the rear end of the propeller shaft.

A clamp bracket 24 which can turn right and left via a swivel shaft (not shown) in order to fix the outboard motor A to a stern 23*a* is located in the upper part of the driving-shaft housing 11.

The outboard motor A can turn to the right and left about the swivel shaft to steer the boat hull 23. This swivel shaft responds to the movement of a handle (not shown) mounted at the top of the driving-shaft housing 11.

The engine cover 10 is vertically divided into two segments, an upper cover segment 16 and a lower cover segment 17. The engine cover 10, as viewed in a plan view from above, substantially forms an ellipse that extends in the traveling direction β of the boat, as shown in FIG. 2.

The upper cover segment 16 has a sufficient volume to enclose almost the entire engine 9 and includes a tilt-up-handle mounting section 21 in the upper rear for mounting a tilt-up handle 20, as shown in FIG. 3.

Figure 2:
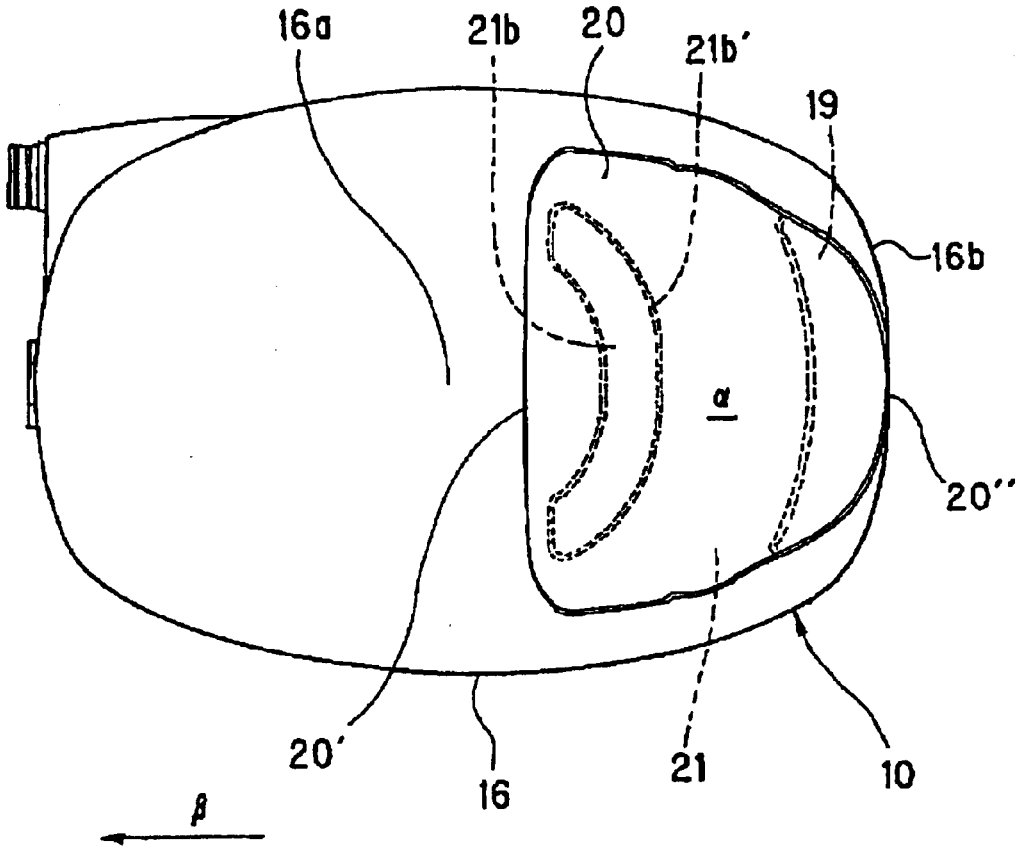
FIG. 2 is a plan view of an engine cover having upper and lower cover segments.

The mounting section 21 has two recessed steps below an upper wall 16*a* of the upper cover segment 16 and has a substantially trapezoidal outline in plan view, as shown in FIG. 2.

Figure 4:
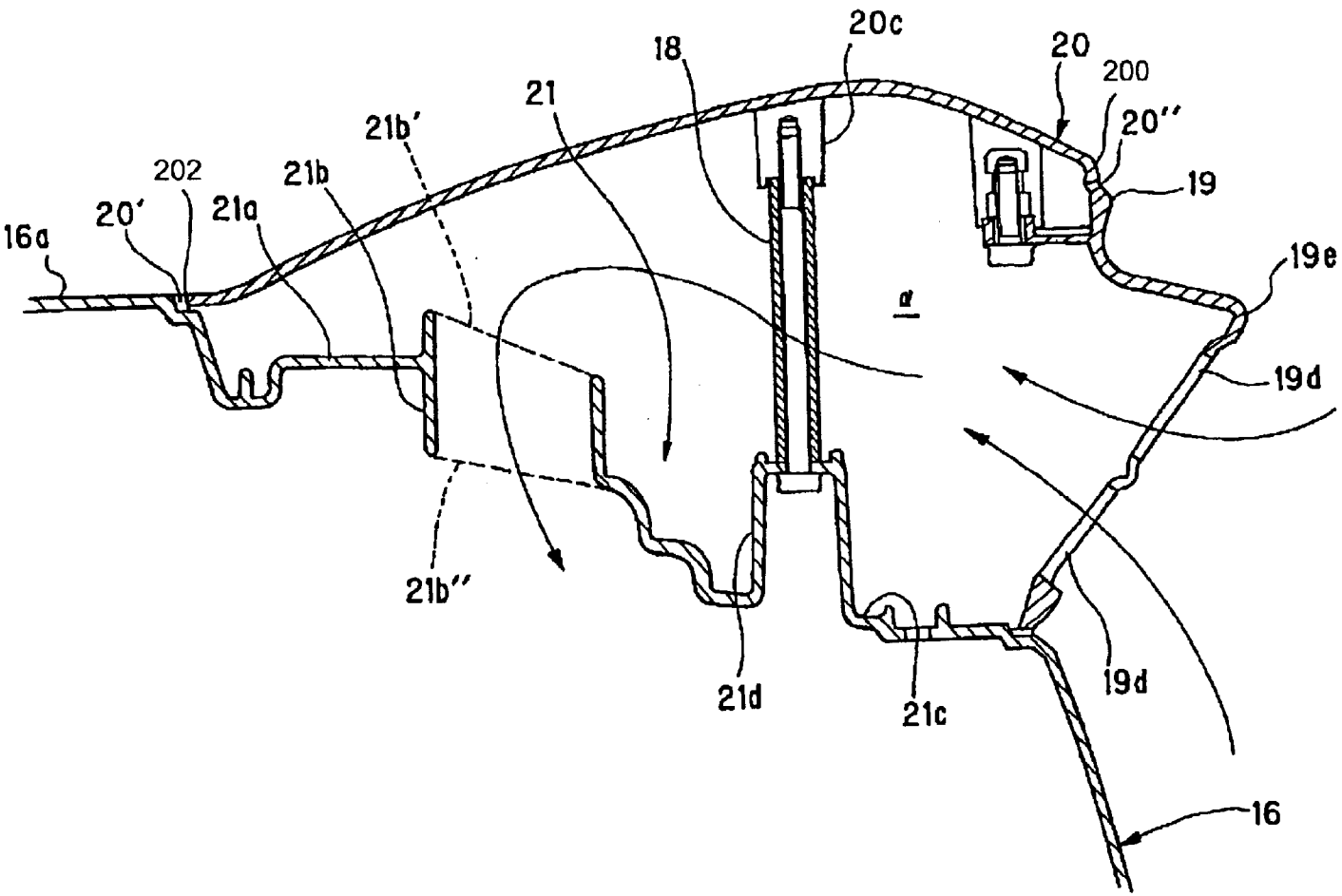
FIG. 4 is an enlarged view of the section surrounded by circle I in FIG. 3.
Figure 5:
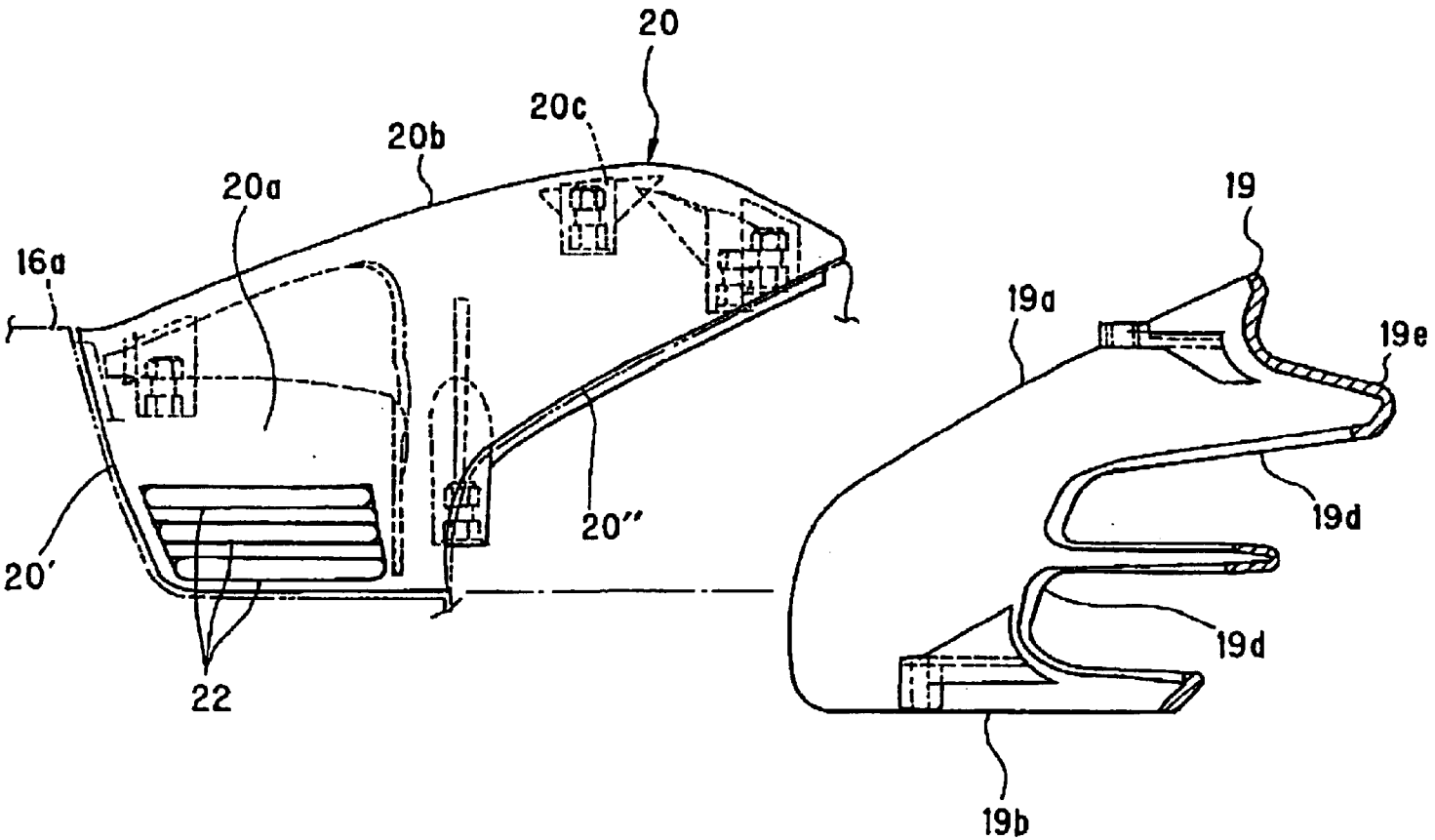
FIG. 5 is a side view separately illustrating a tilt-up handle body and a louver.
Figure 6:
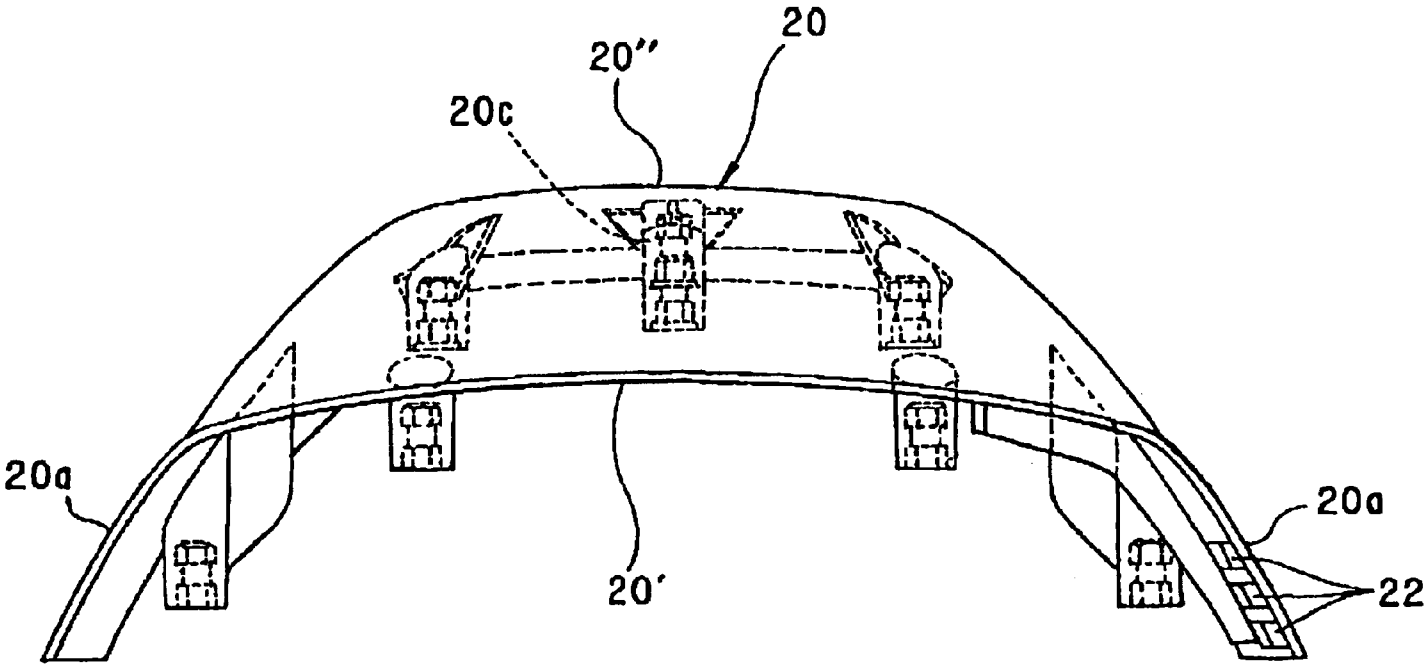
FIG. 6 is a front view of a tilt-up handle body.
Figure 7:
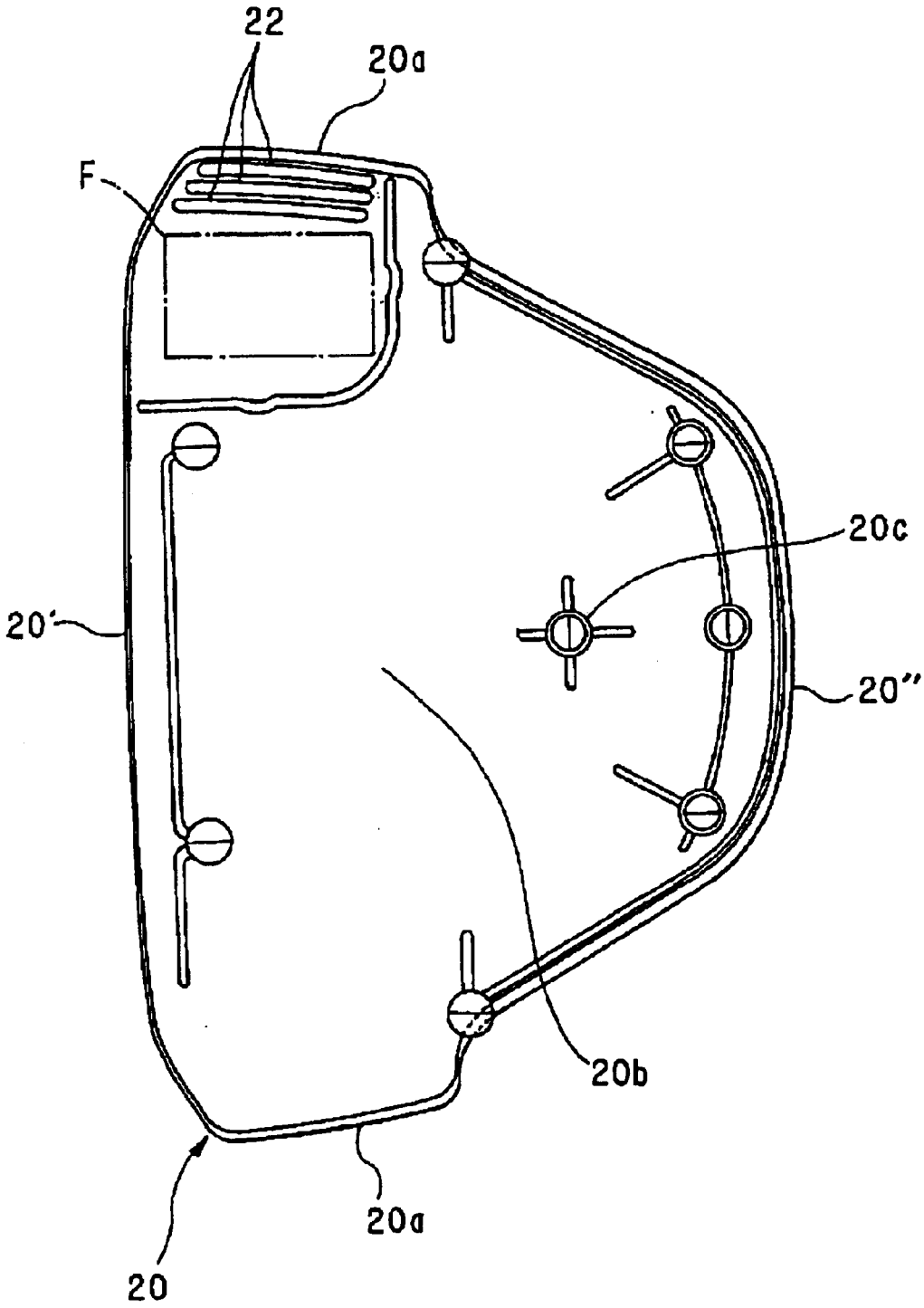
FIG. 7 is a bottom view of a tilt-up handle body.

As shown in FIGS. 3 and 4, an outside-air intake path 21*b* extends vertically from a front stepped face 21*a* of the mounting section 21. A stay 21*d* for mounting the tilt-up handle 20 projects from a rear stepped face 21*c*. A bolt 18 joins the stay 21*d* and a stay 20*c* formed in the tilt-up handle 20.

The outside-air intake path 21*b* is substantially C-shaped in plan view, as shown in FIG. 2. An inlet port 21*b*' opens diagonally rearwardly at a level slightly higher than the front stepped face 21*a*, and an outlet port 21*b*" is formed at a level between the front stepped face 21*a* and the rear stepped face 21*c*, as shown in FIGS. 3 and 4.

In this embodiment, the inlet port 21*b*' is located at a height close to the lower surface of the upper wall 16*a* of the upper case segment 16 and, therefore, the louver 19, as well. Therefore, outside air flows through the tilt-up handle 20 into the engine cover 10.

As shown in FIGS. 1 and 3–5, the tilt-up handle 20 has a downwardly-pointing angular-C shape and extends sideways. The tilt-up handle 20 includes right and left walls 20*a* and an upper wall 20*b*. The upper wall 20*b* gradually bulges upward from the upper wall 16*a* of the upper cover segment 16 of the engine cover 10 before slightly dipping down at rear opening 20" to meet the edge of the louver 19 at the rear in the boat traveling direction β. The rear opening 20" is slightly narrower than the front opening 20' and serves as an outside-air inlet.

When the tilt-up handle 20 is fixed to the mounting section 21, the upper edge of the front opening 20' is almost aligned with the upper wall 16*a* of the upper cover segment 16. The right and left edges of the front opening 20' are also inclined rearwardly from the upper side to the lower side when viewed in profile.

An upper edge 200 of the rear opening 20" is formed at a higher position than the upper edge 202 of the front opening 20'. The right and left edges of the rear opening 20" are curved in profile in a manner such that they are mostly inclined from the upper to lower sides and are substantially vertical near a lower edge of the rear opening 20".

Three ventilating grooves 22 extend horizontally from the front to the rear to serve as parallel ventilation openings in one or both of the right and left walls 20*a*. A ventilating fan F may be placed behind the ventilating grooves 22.

The ventilating fan F may rotate when the engine 9 is driven or may rotate only when a sensor (not shown) in a buffer chamber α detects moisture.

Figure 8:
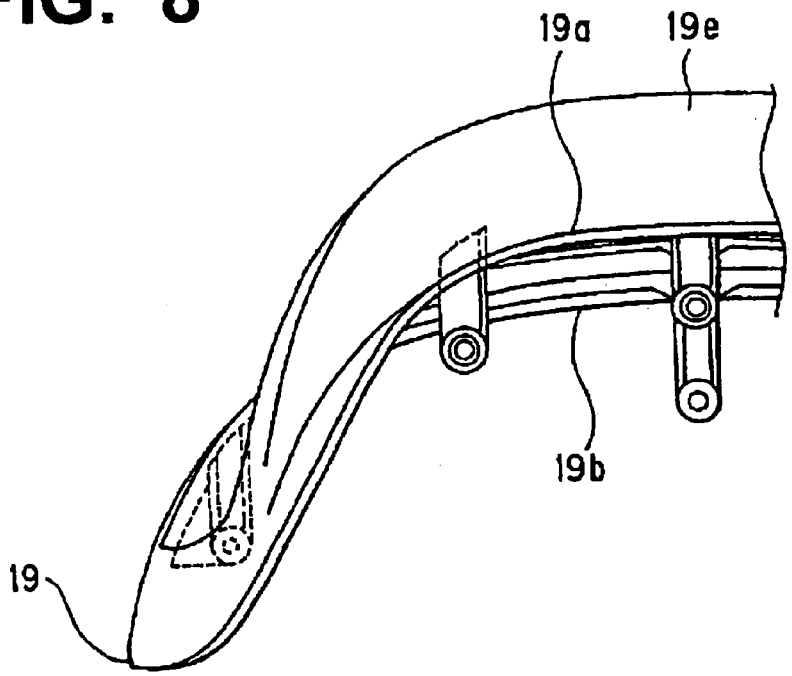
FIG. 8 is a partial plan view of a louver.

The louver 19 is located at the rear opening 20" of the tilt-up handle 20 and is arc-shaped in plan view in alignment with the rear opening 20". The upper and lower edges 19*a* and 19*b* of the louver 19 curve frontwardly from the center toward the right and left sides that align with the sides of the rear opening 20", as shown in FIG. 8.

A buffer chamber α in this embodiment is located within an inner space inside the tilt-up handle 20 formed by mounting the louver 19 at the rear opening 20", as shown in FIGS. 3 and 4.

Figure 9:
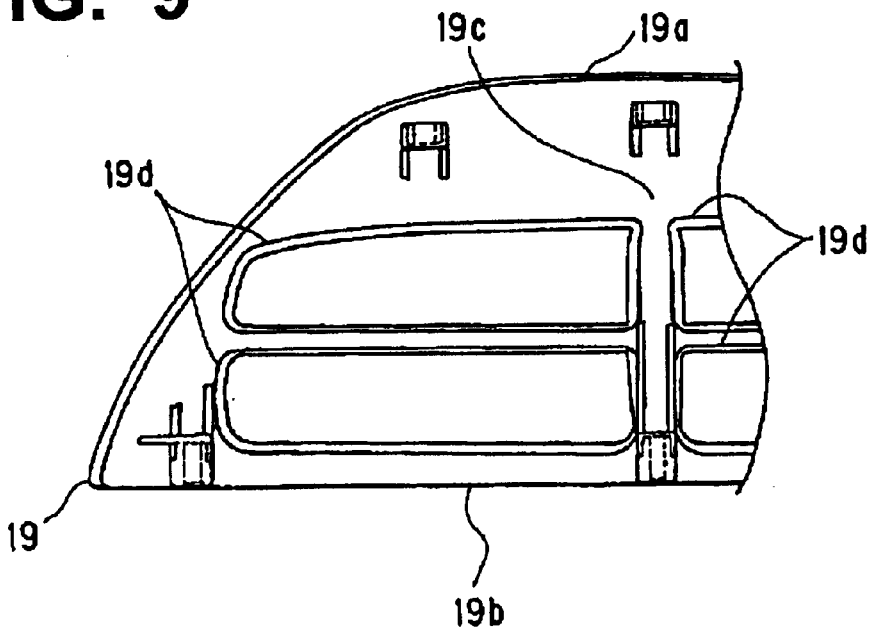
FIG. 9 is a front view of a louver.
Figure 10:
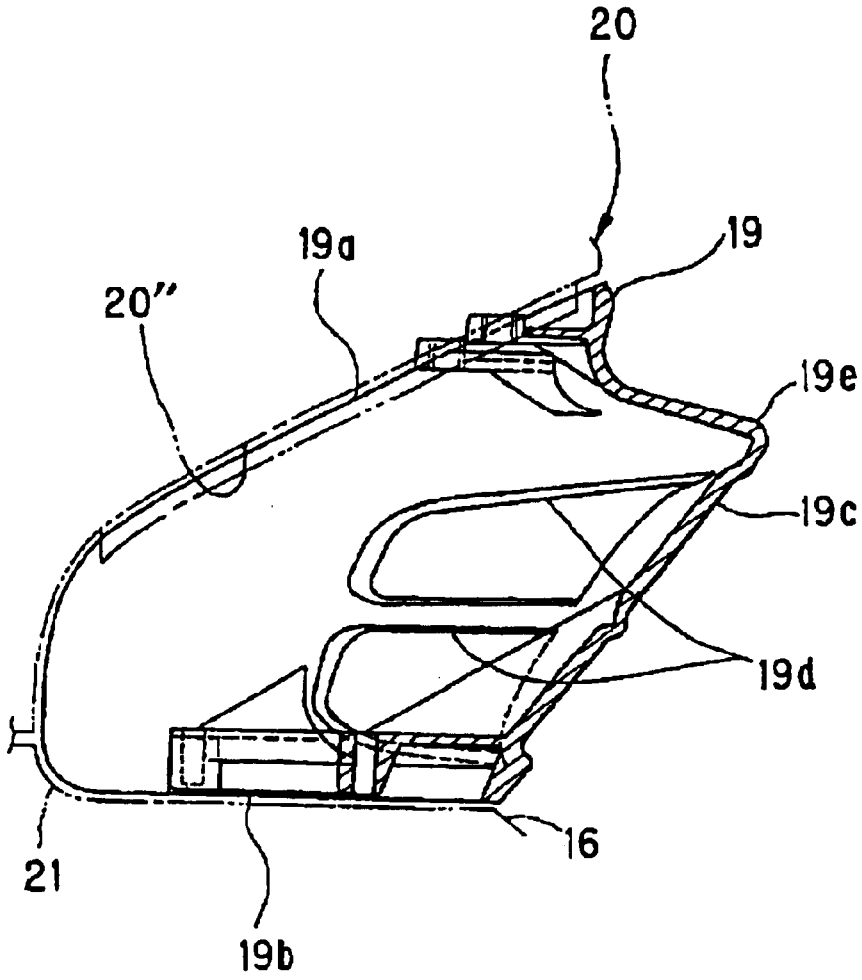
FIG. 10 is a cross-sectional view of a louver.

As shown in FIGS. 9 and 10, the lower edge 19*b* has a straight profile, and the upper edge 19*a* gradually inclines down toward the lower edge 19*b* and from the center to each side.

Upper and lower pairs of right and left intake ports 19*d* are located in an intake-port forming surface 19*c* between the upper edge 19*a* and the lower edge 19*b*. Eaves 19*e* project rearwardly in the boat traveling direction β at the uppermost edge of the upper intake ports 19*d*.

Figure 1:
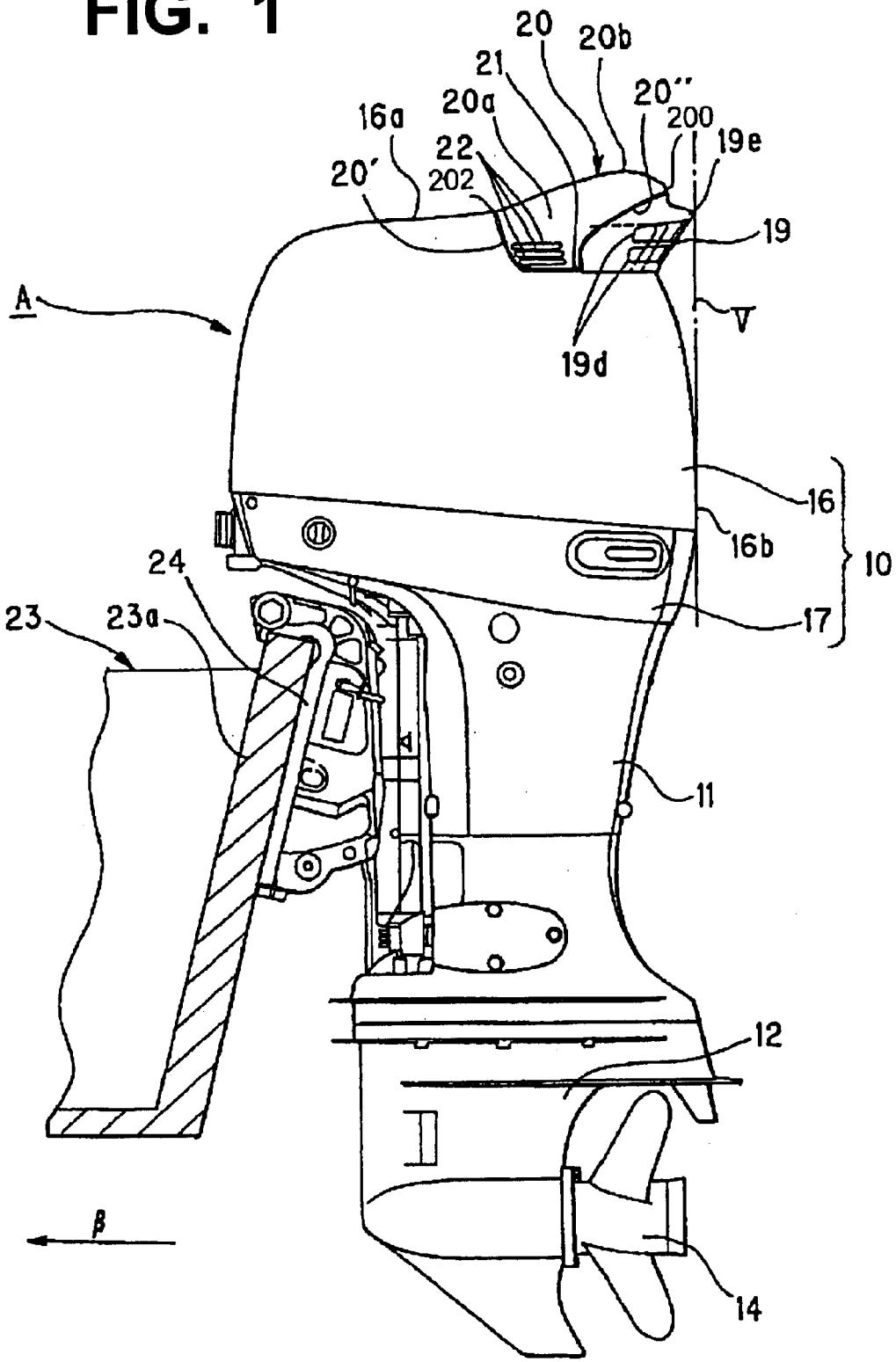
FIG. 1 is a side view of an outboard motor having a tilt-up handle according to an embodiment of the present invention.

These eaves 19*e* project so that their leading ends are positioned on an imaginary vertical line V that overlaps with the profile of the rear wall 16*b* of the engine cover 10, as shown in FIG. 1. In other words, the eaves 19*e* project so that the center of the rearmost edge is aligned with the center of the rear wall 16*b* of the upper cover segment 16 in plan view, as shown in FIG. 2.

The intake-port forming surface 19*c* points diagonally upward toward the rear in the boat traveling direction β when the louver 19 is mounted at the rear opening 20" of the tilt-up handle 20. Therefore, water drops or the like flowing down the surface of the tilt-up handle 20 cannot enter the buffer chamber α of the tilt-up handle 20 through the intake ports 19*d*.

The tilt-up handle 20 described above prevents water from entering the engine cover 10 without compromising the amount of air intake. The profile of the rear opening 20"

serving as the outside-air inlet is almost aligned with the vertical line V overlapping with the rear wall 16*b* of the upper cover 16 of the engine cover 10. Therefore, water drops falling down along the surface of the engine cover 10 or the tilt-up handle 20 do not drop near rear opening 20" but, instead, flow along the rear wall of the engine cover 10. This simple structure prevents water drops from entering the engine cover 10, and water drops splashing near the rear opening 20" do not create mist.

The amount of outside air entering the engine cover 10 is not reduced since the aperture size of the louver 19 need not be reduced to prevent water from entering the tilt-up handle 20. This ensures sufficient air intake.

Additionally, the intake speed of outside air does not increase, which further ensures that mist does not enter the engine cover 10.

Even if water drops and mist do enter the buffer chamber α, they can be discharged through the ventilating grooves 22 in the tilt-up handle 20 by operating the ventilating fan F. Consequently, water drops and mist cannot enter into the engine cover 10 from the buffer chamber α.

Figure 11:
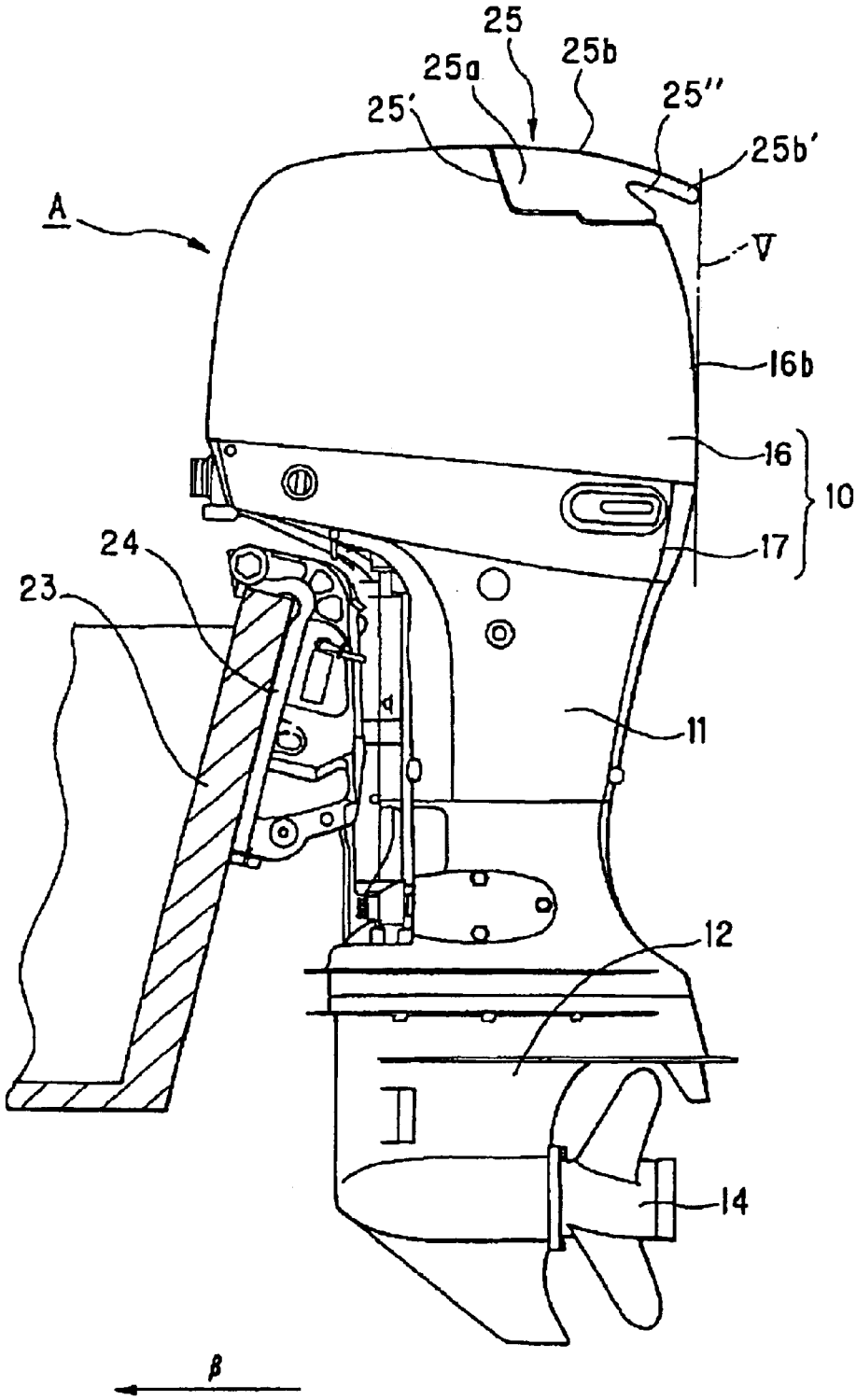
FIG. 11 is a side view of an outboard motor having a tilt-up handle according to an embodiment of the present invention.
Figure 12:
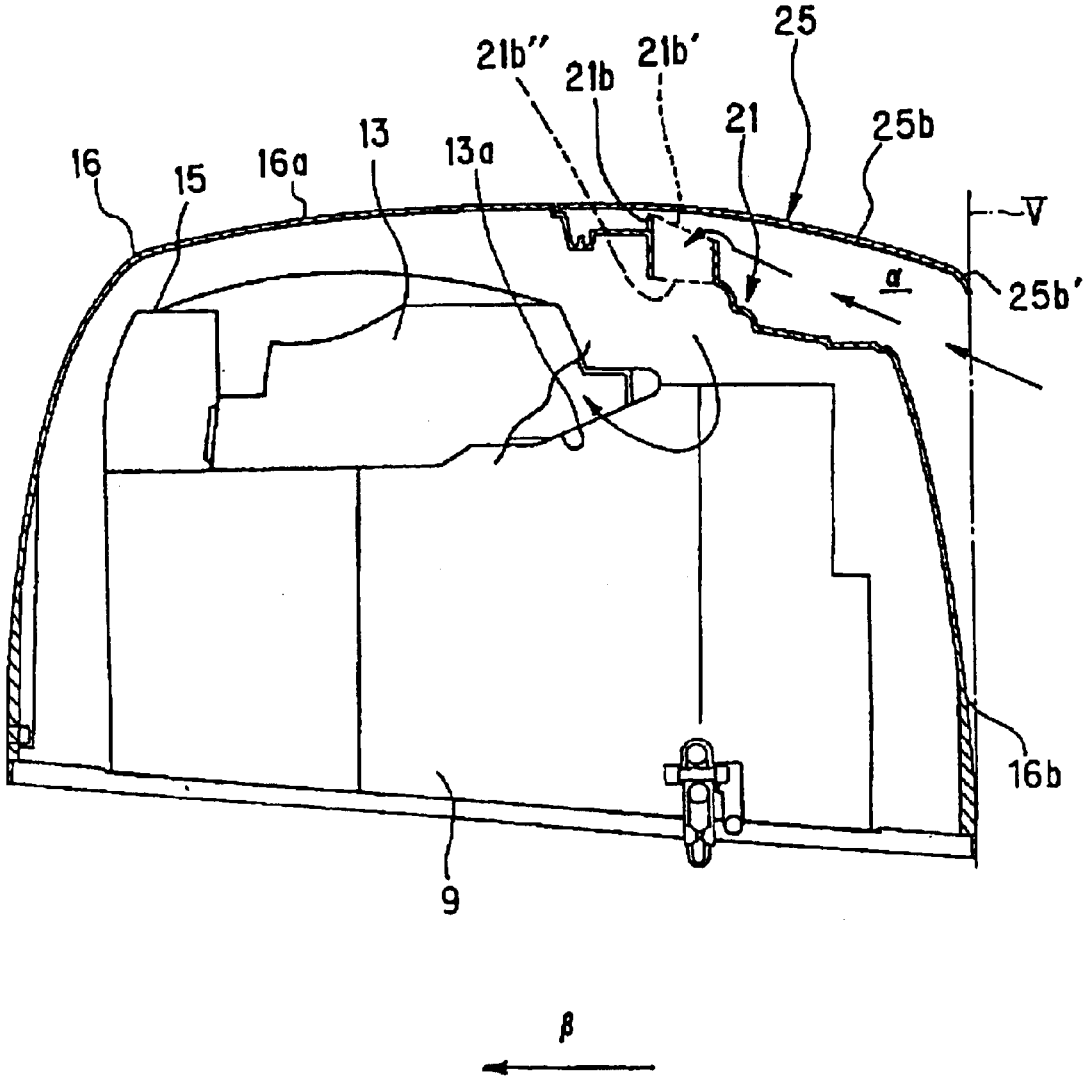
FIG. 12 is a cross-sectional view of an upper cover segment according to an embodiment of the present invention.
Figure 13:
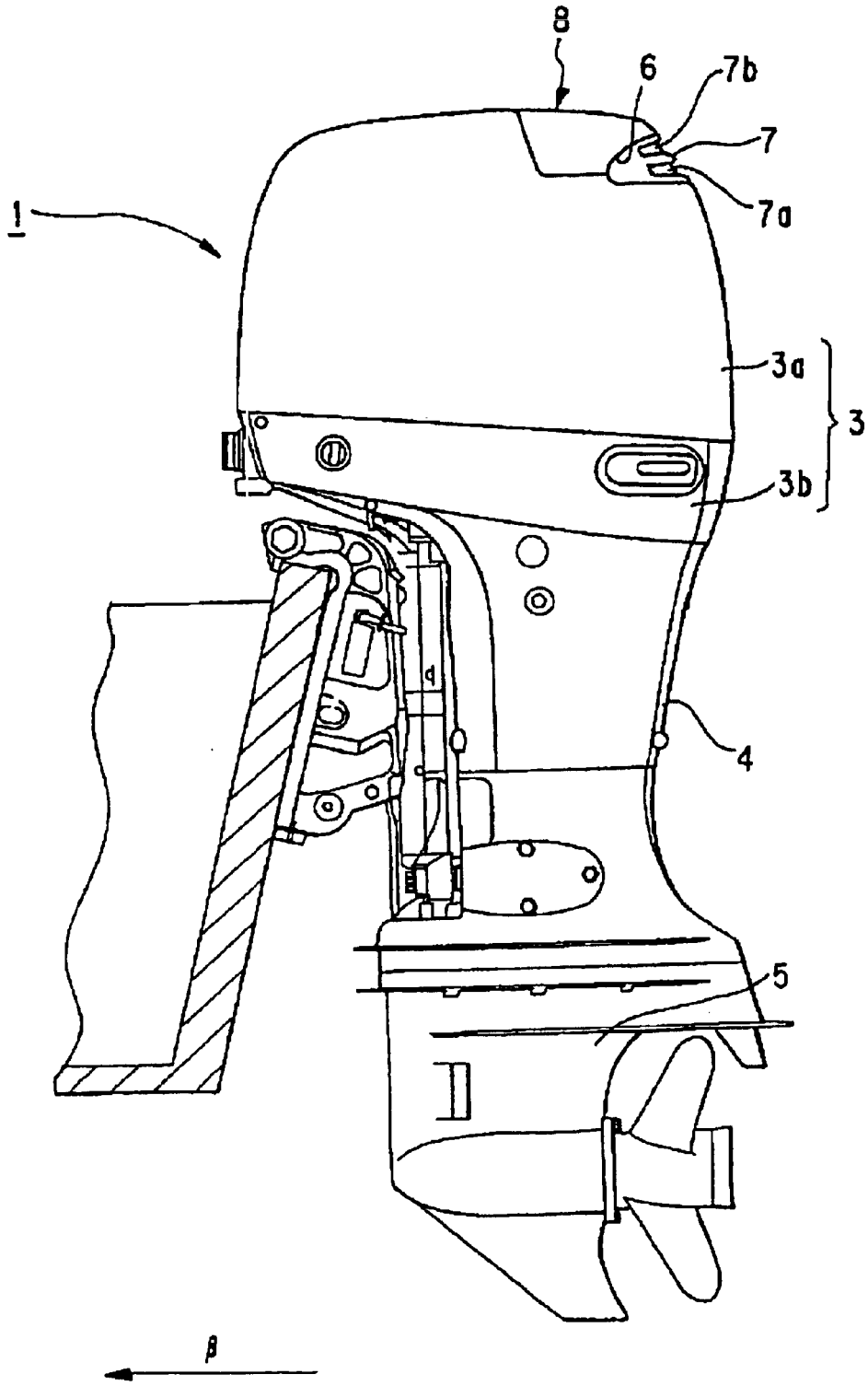
FIG. 13 is a side view of a typical outboard motor.
Figure 14:
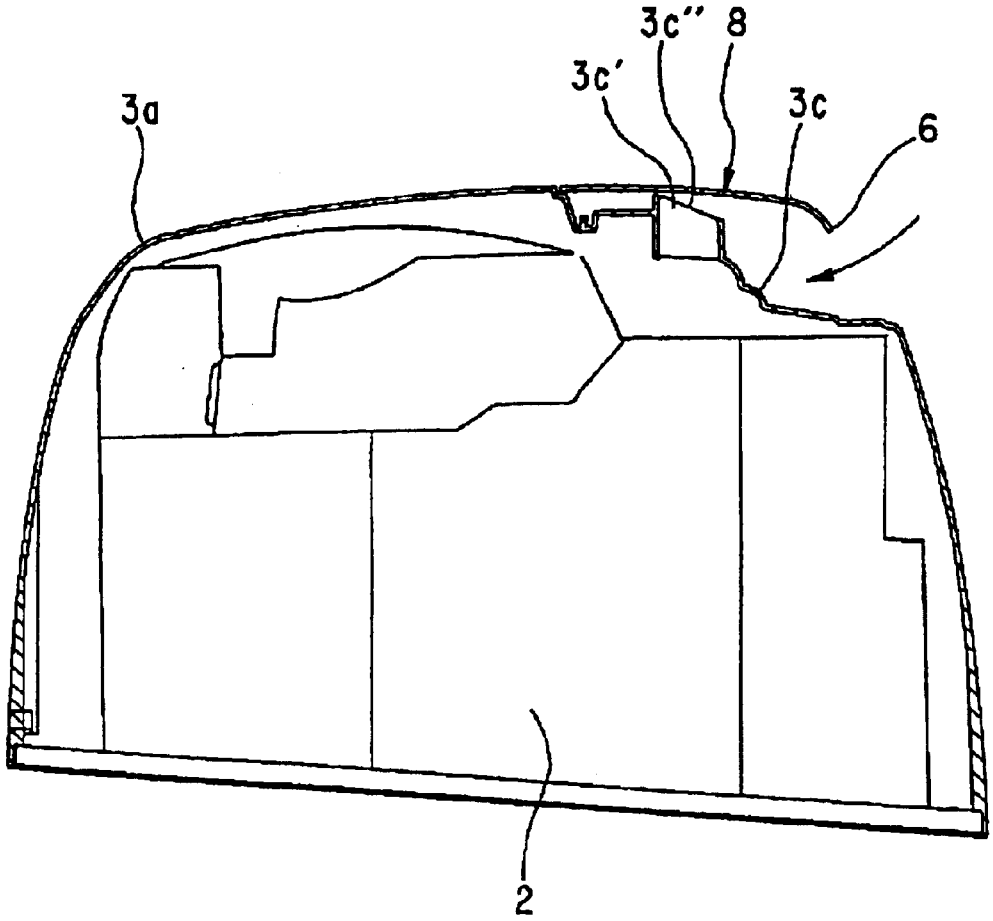
FIG. 14 is a cross-sectional view of a typical upper cover segment.

FIGS. 11 and 12 illustrate a tilt-up handle according to another embodiment of the present invention. Components of an outboard motor using the tilt-up handle of this embodiment are equivalent to those in the above first embodiment and are denoted by the same reference numerals.

A tilt-up handle 25 of this embodiment has a downward-pointing angular-C shape that extends sideways and includes right and left walls 25*a* (only one shown) and an upper wall 25*b*. The tilt-up handle 25 gradually inclines downward from a front opening 25' toward a rear opening 25" which serves as an air inlet. This rear opening 25" is slightly narrower than the front opening 25'. This tilt-up handle 25 does not have a louver and does not bulge upward.

A rear end 25*b*' of the upper wall 25*b* forms an upper edge which defines the rear opening 25" together with the lower, right, and left edges. This rear end 25*b*' forms a shape resembling eaves and is almost aligned with a vertical line V overlapping with the rear wall 16*b* of upper cover segment 16 of an engine cover 10.

Therefore, water drops and the like falling along the surface of this tilt-up handle 25 are blocked by the rear end 25*b*' of the upper wall 25*b* and do not enter buffer chamber α from the rear opening 25".

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A tilt-up handle for an outboard motor having an engine cover, said handle being positioned in an upper rear portion of said engine cover and comprising an outside-air inlet protruding rearwardly in a boat traveling direction from a rear wall of said engine cover, an upper edge of a rear opening of said tilt-up handle at a higher position than an upper edge of a front opening of said tilt-up handle;

wherein said outside air inlet is at least partially aligned with a vertical line overlapping said rear wall of said engine cover when said outboard motor is viewed in profile and a crankshaft of said outboard motor is in a vertical position.

2. A tilt-up handle according to claim 1, further comprising an upper wall bulging upwardly from an upper wall of said engine cover from the front to the rear in the boat traveling direction.

3. A tilt-up handle according to claim 2, further comprising a louver adapted to take in outside air from a lower diagonal side of said louver, said louver being located at said outside-air inlet and opening toward the rear in the boat traveling direction.

4. A tilt-up handle according to claim 3, wherein said louver comprises an intake-port forming surface that points diagonally downward and rearward in the boat traveling direction.

5. A tilt-up handle according to claim 4, wherein an upper end of said intake-port forming surface protrudes rearwardly in the boat traveling direction and is eave-shaped.

6. A tilt-up handle according to claim 3, wherein said tilt-up handle has a substantially downward-pointing angular-C shape that extends sideways and includes right and left walls and said upper wall of said tilt-up handle and further comprises a ventilation opening located in at least one of said right and left walls and a ventilating fan.

7. A tilt-up handle for an outboard motor having an engine cover, said handle being positioned in an upper rear portion of said engine cover and comprising:

(a) an outside-air inlet protruding rearwardly in a boat traveling direction from a rear wall of said engine cover;

(b) an upper wall bulging upwardly from an upper wall of said engine cover from the front to the rear in the boat traveling direction;

(c) a louver adapted to take in outside air from a lower diagonal side of said louver, said louver being located at said outside-air inlet and opening toward the rear in the boat traveling direction, wherein said louver comprises an intake-port forming surface that points diagonally downward and rearward in the boat traveling direction; and wherein said outside air inlet is at least partially aligned with a vertical line overlapping said rear wall of said engine cover when said outboard motor is viewed in profile.

8. A tilt-up handle according to claim 7, wherein an upper end of said intake-port forming surface protrudes rearwardly in the boat traveling direction and is eave-shaped.

9. A tilt-up handle for an outboard motor having an engine cover, said handle being positioned in an upper rear portion of said engine cover and comprising:

(a) an outside-air inlet protruding rearwardly in a boat traveling direction from a rear wall of said engine cover;

(b) an upper wall bulging upwardly from an upper wall of said engine cover from the front to the rear in the boat traveling direction;

(c) a louver adapted to take in outside air from a lower diagonal side of said louver, said louver being located at said outside-air inlet and opening toward the rear in the boat traveling direction;

(d) a substantially downward-pointing angular-C shape that extends sideways and includes right and left walls, said upper wall of side tilt-up handle, a ventilation opening located in at least one of said right and left walls, and a ventilating fan; and wherein said outside air inlet is at least partially aligned with a vertical line overlapping said rear wall of said engine cover when said outboard motor is viewed in profile.

* * * * *